US006582284B2

(12) United States Patent
Bonachera et al.

(10) Patent No.: US 6,582,284 B2
(45) Date of Patent: Jun. 24, 2003

(54) METHOD OF SUPERFINISHING PARTS WITH A CYLINDRICAL SURFACE

(75) Inventors: Richard Bonachera, Vincennes (FR); Raymond Millot, Saint Yon (FR)

(73) Assignee: Societe des Procedes et Machines Speciales, Courcouronnes (FR)

( * ) Notice: Subject to any disclaimer, the term of this patent is extended or adjusted under 35 U.S.C. 154(b) by 91 days.

(21) Appl. No.: 09/794,252

(22) Filed: Feb. 28, 2001

(65) Prior Publication Data

US 2001/0023165 A1 Sep. 20, 2001

(30) Foreign Application Priority Data

Mar. 3, 2000 (FR) ..... 00 02793

(51) Int. Cl.[7] ..... B24B 5/04
(52) U.S. Cl. ..... 451/49; 451/307
(58) Field of Search ..... 451/49, 142, 143, 451/307, 306, 173, 168, 546

(56) References Cited

U.S. PATENT DOCUMENTS 3,101,577 A * 8/1963 Skugghall ..... 451/49
4,203,261 A * 5/1980 Davies ..... 451/307
5,759,089 A * 6/1998 McCoy ..... 451/49
6,358,133 B1 * 3/2002 Cesena et al. ..... 451/546

FOREIGN PATENT DOCUMENTS

| | | |
|---|---|---|
| DE | 10 17 936 | 10/1957 |
| DE | 1 107 115 | 5/1961 |
| DE | 1 944 813 | 5/1971 |
| EP | 0 575 823 | 12/1993 |
| FR | 1 261 304 | 9/1961 |

* cited by examiner

*Primary Examiner*—Robert A. Rose
(74) *Attorney, Agent, or Firm*—Smith, Gambrell & Russell, LLP

(57) ABSTRACT

A method of superfinishing the cylindrical surface of a part which is intended to be mounted in circular guides and to be moved in translation along its axis relative to the guides places an abrasive applicator wheel so that its axis is perpendicular to the axis of the part and its lateral surface is pressed against the cylindrical surface. The wheel is driven in rotation about its axis and the part and/or the wheel is driven simultaneously by movement in translation along the axis of the part and rotation about the axis at speeds such that the whole of the cylindrical surface is abrasively machined longitudinally along a helical trace whose successive turns overlap. Applications include steering racks for automobiles, for example.

17 Claims, 3 Drawing Sheets

METHOD OF SUPERFINISHING PARTS WITH A CYLINDRICAL SURFACE

BACKGROUND OF THE INVENTION

1. Field of the Invention

The present invention relates to a method of superfinishing the cylindrical surface of parts intended to be mounted in circular guides and to be moved in translation along their axis relative to said guides.

2. Description of the Prior Art

Many machine parts move in translation, such parts being mounted with their cylindrical surfaces in circular guides (translation bearings). One illustrative example of a part of this kind is an automobile vehicle steering rack.

The cylindrical surfaces of such parts are generally straightened before they are subjected to a superfinishing operation, for example lapping, if necessary. All such machining operations carried out with the parts rotating form on the parts more or less fine circular or helicoidal scratches or striations, the orientation of the scratches or striations being conditioned by the relative movement of the part and the tool during machining.

Such striations or scratches, even if they are very fine, cause unwanted noise, friction and vibration when the parts move in axial translation relative to their guides.

To remedy this drawback, i.e. to eliminate the circular or helicoidal striations or scratches, it has already been proposed to submit the cylindrical surface of such parts to "longitudinal superfinishing" which consists of machining it with the lateral surface of an abrasive wheel driven in rotation about its axis, which is oriented perpendicularly to the axis of the part, and by moving the wheel or the part in translation along the axis of the part. This "longitudinal superfinishing" eliminates the circular or helicoidal striations or scratches resulting from conventional straightening or superfinishing at the cost of producing longitudinal striations or scratches which, because they are parallel to the axis of the part, cause much less vibration, friction and noise when the part is afterwards moved in axial translation relative to its guide.

In the longitudinal superfinishing method used until now, a plurality of successive passes are performed on the cylindrical surface to be machined, each pass machining a segment of the cylindrical surface of the part, which is not rotated and is offset angularly between two successive passes until the whole of the cylindrical surface has been machined by means of a plurality of successive axial passes.

The prior art method is relatively slow and difficult to automate.

Also, longitudinal superfinishing by the prior art method is effected by direct contact between a flexible abrasive wheel and the surface to be machined, which leads to relatively fast wear and soiling of the abrasive wheel.

The present invention is aimed at a method of "longitudinal superfinishing" of the cylindrical surface of parts which enables the parts to be machined faster and which can be extensively automated.

The invention is also aimed at a "longitudinal superfinishing" method which reduces the propensity to wear and soiling of the prior art method.

SUMMARY OF THE INVENTION

The method in accordance with the invention of superfinishing the cylindrical surface of a part which is intended to be mounted in circular guides and to be moved in translation along its axis relative to the guides consists of placing an abrasive applicator wheel so that its axis is perpendicular to the axis of the part and its lateral surface is pressed against the cylindrical surface, driving the wheel in rotation about its axis and moving the part and/or the wheel so that the cylindrical surface of the part is abrasively machined longitudinally in its entirety, characterized in that the wheel and/or the part is simultaneously moved in translation along the axis of the part and rotated about the axis at speeds such that the whole of the cylindrical surface is abrasively machined longitudinally along a helical trace whose successive turns overlap.

The cylindrical surface of a part can therefore be machined all at once in a single pass, and thus in an operation that is easy to automate.

From the point of view of implementing the method, it is simpler to rotate the part about its axis and to move the abrasive applicator wheel in translation along the axis of the part.

In accordance with the invention, the abrasive is preferably applied by a wheel at least the outside lateral surface of which is flexible.

The outside lateral surface of the wheel preferably includes a circumferential groove having a circular arc profile whose radius is substantially equal to the radius of the cylindrical surface of the part to be machined.

In a preferred embodiment of the invention the abrasive is applied by passing an abrasive strip over the lateral surface of the wheel and the strip is caused to perform a continuous forward movement during machining by rotating the wheel.

Although an abrasive strip of finite length can be used in the context of the invention, paid out from a pay-out spool and rewound onto a take-up spool, an endless abrasive strip is advantageously used.

The wheel is preferably pressed with a controlled constant force against the cylindrical surface to be machined.

The machining method according to the invention and one example of a machine for implementing the method are described in more detail hereinafter with reference to the accompanying diagrammatic drawings.

DETAILED DESCRIPTION OF THE PREFERRED EMBODIMENTS

Figure 1:
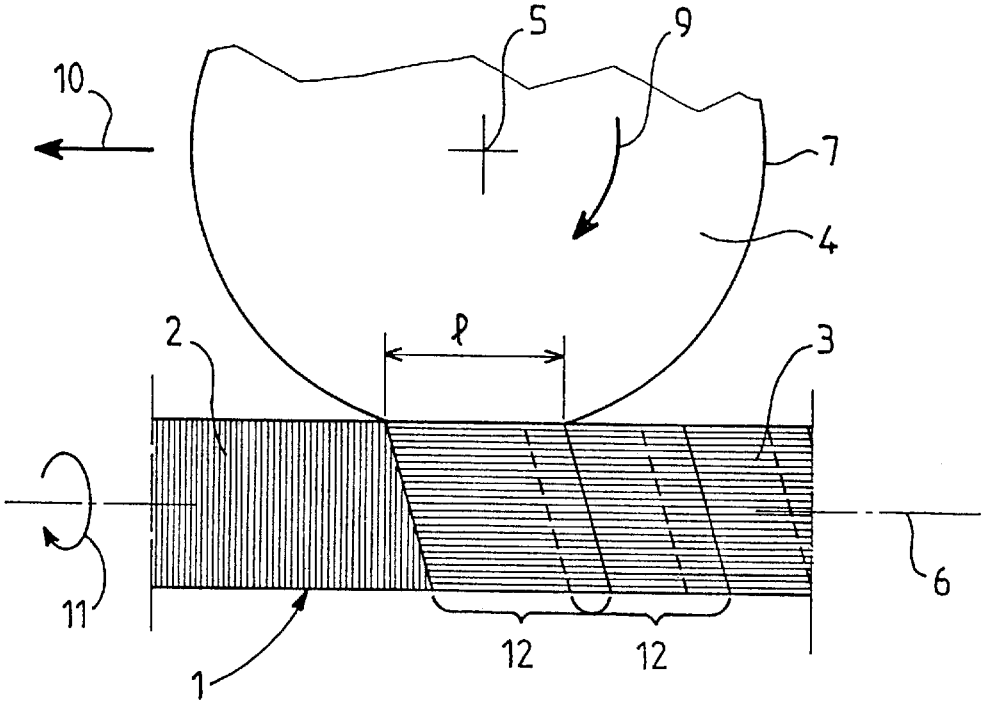
FIGS. 1 and 2 are diagrammatic side and end views of a cylindrical part during its machining in accordance with the invention by "longitudinal superfinishing".
Figure 2:
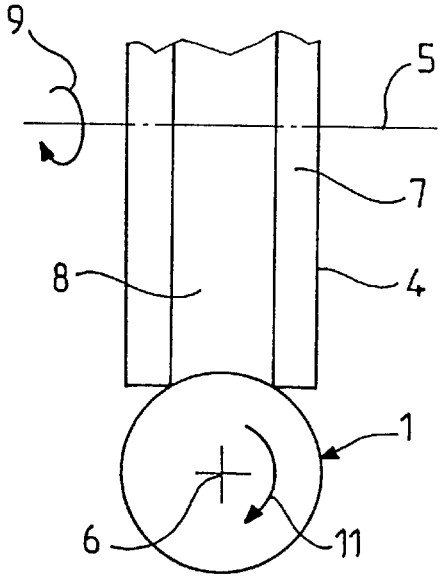

In FIGS. 1 and 2, a part 1, of which only a portion is shown in FIG. 1, has a cylindrical surface which has been machined in the usual way to straighten it and where applicable by conventional superfinishing, which operations leave more or less fine circular or helicoidal striations or scratches 2 on the surface. To eliminate the circular or helicoidal scratches 2 the cylindrical surface of the part 1 is subjected to "longitudinal superfinishing" with the object of substituting longitudinal scratches 3 for the circular or helicoidal scratches 2 (see FIG. 1).

To this end, an abrasive applicator wheel 4 whose rotation axis 5 is perpendicular to the rotation axis 6 of the part 1 is disposed relative to the part 1 so that its lateral or circumferential surface 7 bears against the cylindrical surface of the part 1.

In this example, the lateral surface 7 of the wheel is in direct contact with the cylindrical surface of the part 1. The wheel 4 is therefore an abrasive wheel.

As shown in FIG. 2, the lateral surface 7 of the wheel 4 includes a circumferential groove 8 with a circular arc profile whose radius matches the radius of the part 1.

At least the exterior part of the wheel 4 is flexible. Accordingly, when the wheel 4 is pressed with a predetermined force against the part 1, it is deformed at the level of the interface with the part 1, which establishes contact between the wheel 4 and the part 1 over a length 1 parallel to the axis 6 of the part 1 (see FIG. 1).

The wheel 4 is driven in rotation in the direction of the arrow 9 and is moved in translation in the direction of the arrow 10 and the part 1 is prevented from moving in translation and is rotated about its axis 6 in the direction of the arrow 11 at speeds such that the abrasive applicator wheel 4 produces on the cylindrical surface of the part 1 a helicoidal trace 12 of longitudinal striations or scratches 3, whose width corresponds to the length l, the successive turns of the trace 12 overlapping (over a portion of the width "l" of the trace).

Figure 3:
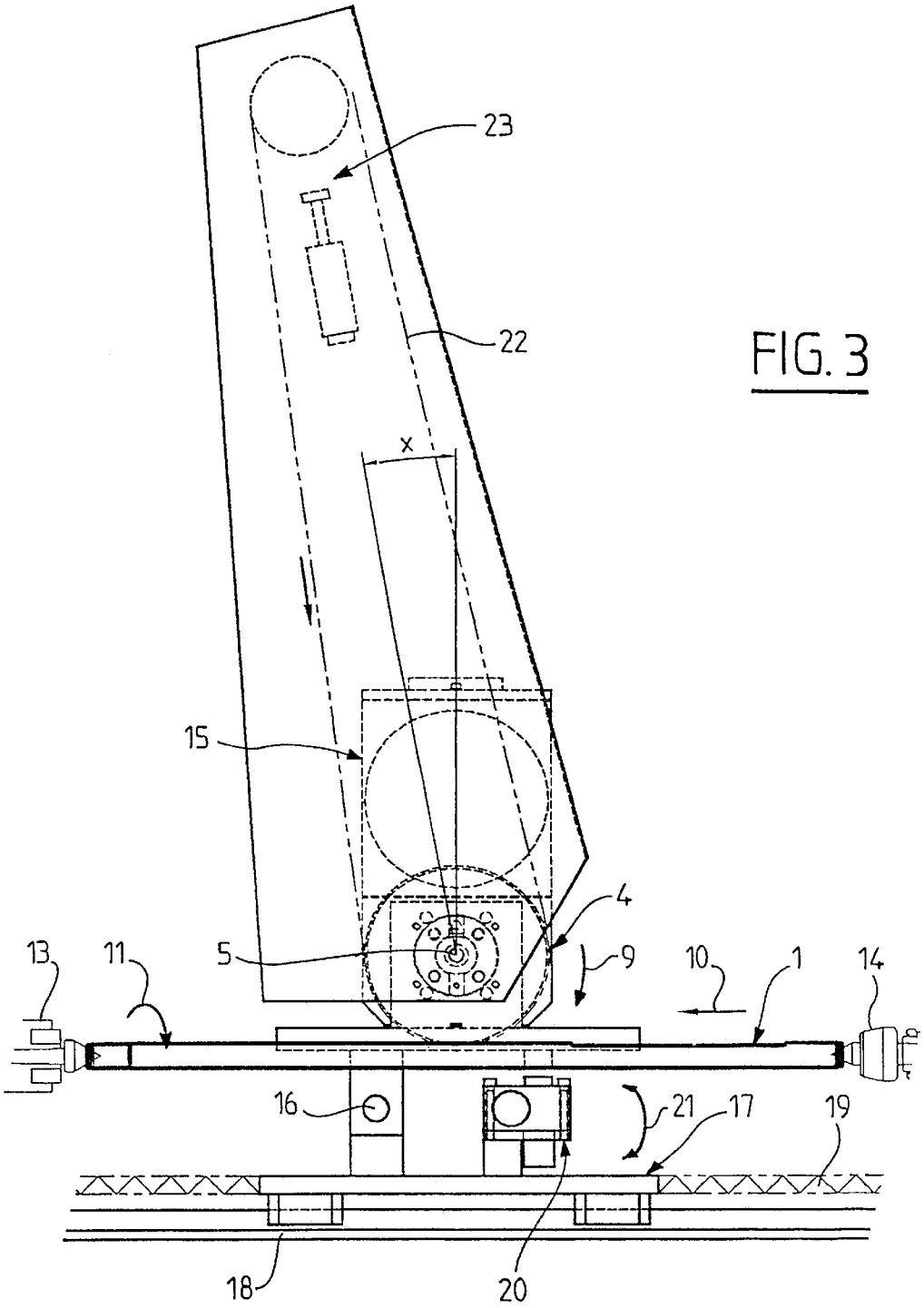
FIGS. 3 and 4 are corresponding views of a machine for implementing the method.
Figure 4:
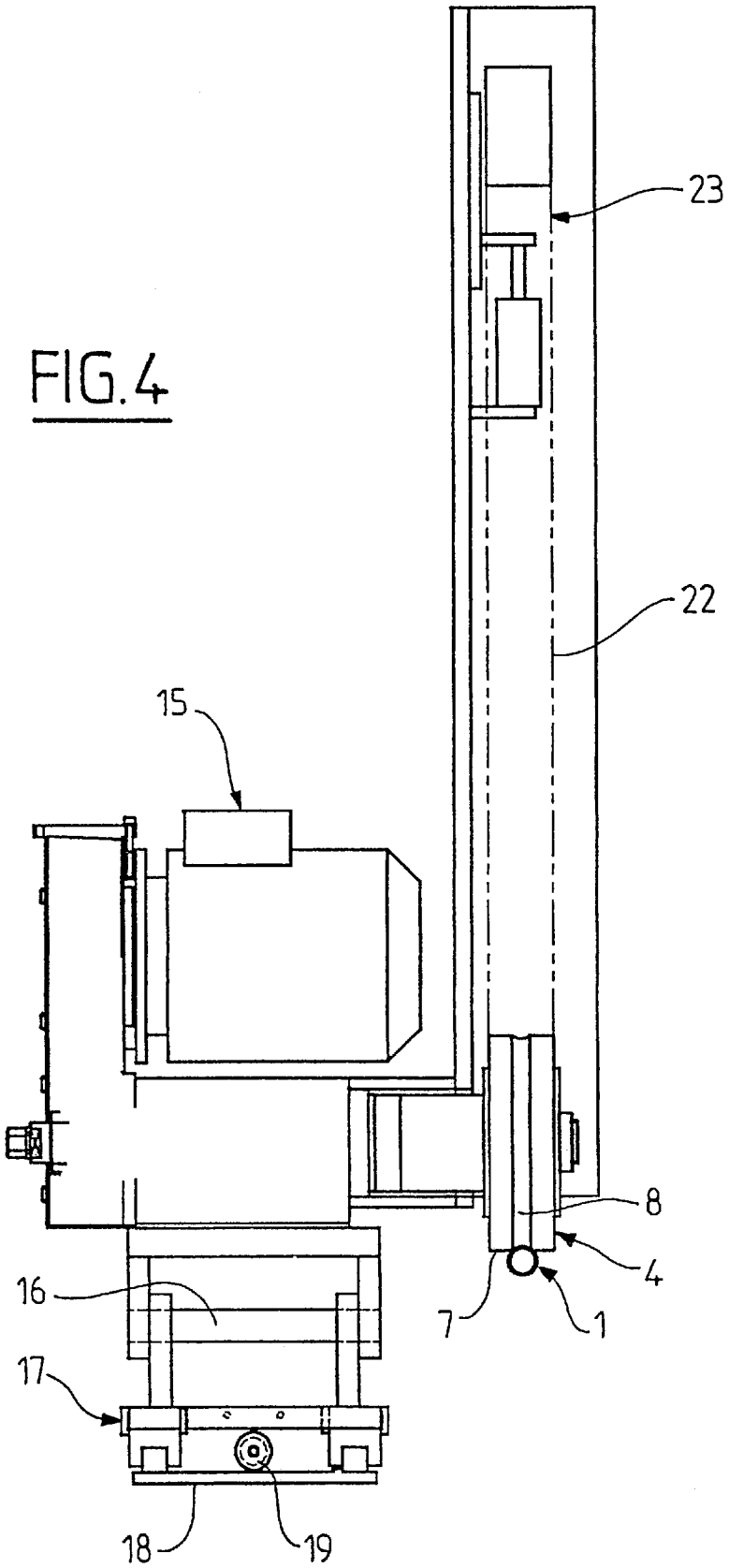

FIGS. 3 and 4 show one embodiment of a machine for implementing the method according to the invention.

FIGS. 3 and 4 show a part 1 to be machined, consisting in this example of a steering rack mounted between two points 13 and 14 and driven in rotation about its axis (arrow 11). They also show an abrasive applicator wheel 4 driven in rotation about its axis 5 (arrow 9) which is perpendicular to the rotation axis of the part 1.

FIG. 4 shows in particular that the wheel 4 is driven by a motor-gearbox 15 and mounted directly on the output shaft of the gearbox. The motor-gearbox 15 can pivot about an axis 16 perpendicular to the axis of the part 1 on a stable carriage 17 that is moved in translation on a guide path 18 parallel to the axis of the part 1 (arrow 10) by drive means, not shown in detail, for example a screw system 19.

A control device 20 shown diagrammatically in FIG. 3, for example a screw abutment system or a piston and cylinder actuator, controls the pressure with which the abrasive is pressed against the part 1 by pivoting the assembly 15-4 about the axis 16 (arrow 20).

FIG. 4 shows that the wheel 4 has on its outside lateral surface 7 a circumferential groove 8 whose radius of curvature matches, i.e. is substantially equal to, the radius of the part 1.

In the context of the invention, the abrasive machining of the cylindrical surface of the part 1 can be effected as shown in FIGS. 1 and 2 directly by the wheel 4, which in this case is an abrasive wheel, preferably a "3M Scotch Brite" flexible abrasive wheel from 3M France, which is made from unwoven synthetic fibers with more or less fine abrasive grains, depending on the required finish.

However, to make the machining more regular, to reduce the propensity to wear and soiling of an abrasive wheel of this kind in direct contact with the surface to be machined, and to enable problem-free machining of parts whose cylindrical surface is interrupted from place to place, for example by a toothed portion as in the case of a steering rack, it is preferable to use an abrasive strip that is passed over the wheel 4, which presses it against the cylindrical surface of the part 1, the wheel 4 serving only as a bearing (and drive) wheel.

FIGS. 3 and 4 show an endless abrasive strip 22 which is tensioned by a system 23 of idler and tensioning rollers.

Particularly remarkable results have been obtained using a "structured abrasive" strip (pyramidal abrasive microstructures) such as the "3M Trizact" strip from 3M France.

When an abrasive strip 22 is used, the wheel 4 can be a non-abrasive wheel of which at least the outside lateral surface is preferably flexible. It can be a COURBHANE elastomer wheel from COURBIS SYNTHESE, 26100 ROMANS SUR ISERE, for example.

In this case, the circumferential groove 8 in the lateral surface 7 of the wheel 4 ensures flexible application of the moving abrasive strip 22 to the surface 7 of the rotating wheel 4. Because of the applied pressure, as the strip wears with use it is elastically deformed more and more deeply in the groove 8 in the area of contact with the part 1, wrapping more and more around the cylindrical surface of the part. The increased flexibility of the abrasive strip as it wears in use can be compensated by the control system 20, for example, which in this case can advantageously take the form of an abutment system slaved to the period of time for which the abrasive strip has been in use, for example to the number of parts already machined by the same abrasive strip.

This increasing deformation of the continuously moving endless abrasive strip as it wears in use has the advantage, in the context of its use in accordance with the invention in combination with an abrasive applicator wheel with a circumferential groove, that the part is always machined by a portion of the strip incorporating "new" abrasive, i.e. initially by the middle portion of the width of the strip and thereafter by two lateral portions which progressively move towards the two opposite lateral edges of the strip as it is deformed between the part to be machined and the applicator wheel, as the depth to which the abrasive strip is pressed into the circumferential groove of the wheel increases because of the increased flexibility of the strip.

It should be noted that the embodiment shown and described is shown and described by way of relative and non-limiting example only and that many modifications and variants are feasible within the scope of the invention.

This refers in particular to the manner in which the two relative movements of the abrasive applicator wheel 4 and the part 1 to be machined are produced, that is to say the movement in translation along the axis of the part (at the level of the wheel 4) and the movement in rotation about the axis of the part (at the level of the part 1 in the example shown).

There is claimed:

1. A method of superfinishing a cylindrical surface of a part comprising:

placing an abrasive applicator wheel so that an axis of rotation of the abrasive applicator wheel is perpendicular to a longitudinal axis of said part, pressing a lateral surface of the abrasive applicator wheel against the cylindrical surface of said part, driving the abrasive applicator wheel in rotation about the axis of rotation of the abrasive applicator wheel, and moving one or both of said part and said abrasive applicator wheel so that the cylindrical surface of said part is abrasively machined longitudinally, wherein the moving of one or both of said part and said abrasive wheel is carried out simultaneously with a rotating of one or both of said part and said abrasive applicator wheel so that the cylindrical surface is abrasively machined longitudinally along a helical trace whose successive turns overlap, and wherein the abrasive applicator wheel has a circumferential groove having a circular arc profile radius that matches a radius of curvature of said cylindrical surface of said part.

2. A method according to claim 1, wherein said part is rotated about the longitudinal axis of said part.

3. A method according to claim 1, wherein said abrasive applicator wheel is moved in translation along the longitudinal axis of said part.

4. A method according to claim 1, wherein the abrasive applicator wheel has an exterior part that is flexible.

5. A method of superfinishing a cylindrical surface of a part having an axis, comprising the steps of:

placing an abrasive applicator wheel so that an axis of the abrasive applicator wheel is perpendicular to the axis of said part, said abrasive applicator wheel having a lateral surface and a circumferential groove located in the lateral surface having a circular arc profile, passing an abrasive strip over the lateral surface of said abrasive applicator wheel, pressing the abrasive applicator wheel against said cylindrical surface of said part, driving said abrasive applicator wheel in rotation about the axis of the abrasive applicator wheel, moving said abrasive applicator wheel relative to said part in translation along the axis of said part and in rotation about said axis of said part at speeds such that the cylindrical surface is abrasively machined longitudinally along a helical trace whose successive turns overlap.

6. A method according to claim 1, wherein an abrasive is pressed against said cylindrical surface by the abrasive applicator wheel.

7. A method according to claim 1, wherein said abrasive applicator wheel presses an abrasive strip against said cylindrical surface of the part.

8. A method according to claim 7, wherein the abrasive strip is an endless abrasive strip.

9. A method according to claim 1, wherein said abrasive applicator wheel is pressed with a controlled force onto said cylindrical surface to be machined.

10. A method according to claim 9, wherein the abrasive applicator wheel is supported by a support pivotally attached to a carriage, and the pressing of the abrasive applicator wheel with the controlled force includes pivotal movement of said support and said abrasive applicator wheel closer to said part.

11. A method according to claim 1, wherein the part is abrasively machined longitudinally over an entirety of the cylindrical surface.

12. A method according to claim 5, wherein said abrasive applicator wheel is pressed with a controlled force onto said cylindrical surface to be machined.

13. A method according to claim 5, wherein said part is rotated about the longitudinal axis of said part.

14. A method according to claim 5, wherein said abrasive applicator wheel is moved in translation along the axis of said part.

15. A method according to claim 5, wherein said abrasive applicator wheel has an exterior part that is flexible.

16. A method according to claim 5, wherein a radius of curvature of the circumferential groove matches said cylindrical surface of said part.

17. A method according to claim 5, wherein an endless abrasive strip is placed in the circumferential groove.

* * * * *